US005167805A

United States Patent [19]

Theiss

[11] Patent Number: 5,167,805

[45] Date of Patent: Dec. 1, 1992

[54] POOL SKIMMER

[76] Inventor: Alan E. Theiss, 639 Old New York Rd., Port Republic, N.J. 08241

[21] Appl. No.: 753,349

[22] Filed: Aug. 30, 1991

[51] Int. Cl.[5] ..... E04H 4/16; F16D 1/10; F16B 7/10

[52] U.S. Cl. ..... 210/169; 210/237; 210/238; 210/232; 210/328; 210/329; 210/470; 15/1.7; 403/108; 403/109; 403/DIG. 4

[58] Field of Search ..... 210/237, 238, 169, 470, 210/471, 328, 232, 241, 329; 15/1.7; 403/108, 109, DIG. 4

[56] References Cited

U.S. PATENT DOCUMENTS

| | | | |
|---|---|---|---|
| 2,367,997 | 1/1945 | Chambers | 210/169 |
| 2,693,161 | 11/1954 | Stubbs | 43/14 |
| 4,247,216 | 1/1981 | Pansini | 15/1.7 |
| 4,369,109 | 1/1983 | Edge | 210/169 |
| 4,518,495 | 5/1985 | Harding | 210/169 |
| 4,557,001 | 12/1985 | Burkhart | 210/169 |
| 4,819,293 | 4/1989 | Nicholson | 15/1.7 |
| 4,822,487 | 4/1989 | Soich | 210/238 |
| 4,846,972 | 7/1989 | Anderson | 210/238 |
| 4,888,842 | 12/1989 | McKamey | 210/470 |
| 5,024,757 | 6/1991 | Malak | 210/470 |
| 5,043,060 | 8/1991 | Brennan | 210/169 |
| 5,072,538 | 12/1991 | Hendricks | 210/470 |

*Primary Examiner*—Stanley S. Silverman
*Assistant Examiner*—Thomas M. Lithgow
*Attorney, Agent, or Firm*—Jacobson, Price, Holman & Stern

[57] ABSTRACT

A pool skimmer of the invention includes a pair of rectangular frames hinged together along adjacent first short frame members by a plastic hinge member extending substantially the length of the short frame members, a pair of poles attached at an intermediate position along each of the short frame members and a net held by each of the frames. The pool skimmer is almost as wide as the pool being skimmed. The hinged frames are folded together when the skimmer is not being used. In use, the skimmer is unfolded and two operators, each holding a pole, position the skimmer in the water at one end of the pool and walk along opposite sides of the pool with the skimmer in the water between them. At the other end of the pool, the skimmer is removed from the water, debris collected in the net is emptied and the skimmer is folded for storage.

10 Claims, 1 Drawing Sheet

POOL SKIMMER

FIELD OF THE INVENTION

The invention relates to hand-held devices for skimming a swimming pool.

BACKGROUND OF THE INVENTION

Known hand-held pool skimming devices take an unnecessarily long time for operation as the user must walk around the pool while skimming debris from the surface of the water with a net or other device.

The patent to Soich, U.S. Pat. No. 4,822,487, describes a pool skimmer having a rigid rectangular frame and a net. The operator walks around the perimeter of the pool while skimming. McKamey et al., U.S. Pat. No. 4,888,842, describes a swimming pool cleaning mechanism in which a net is wheeled over the floor of a pool for gathering debris therefrom. The patent to Burkhart, U.S. Pat. No. 4,557,001, describes a flexible pool skimmer having one end secured to the side of the pool. The other end is guided around the pool perimeter to gather up debris on the surface of the water. Harding, U.S. Pat. No. 4,518,495, describes a skimmer having attached floats, which is pulled around the surface of a pool. The patent to Anderson, U.S. Pat. No. 4,846,972 describes another skimmer which is pulled around the surface of the pool. The pool skimming net of Edge, U.S. Pat. No. 4,369,109, employs a frame attached to the side of the pool.

SUMMARY OF THE INVENTION

A pool skimmer of the invention includes a pair of rectangular frames each having a pair of opposite short frame members and a pair of opposite long framed members. The frames are hinged together along adjacent first short frame members by a plastic hinge member extending substantially the length of the short frame members. A pair of handles or poles are attached at an intermediate position along each of the outer short frame members and a net is held by each of the frames. The pool skimmer is almost as wide as the pool being skimmed. The hinged frames are folded together when the skimmer is not being used.

In use, the skimmer is unfolded and two operators, each holding a pole or handle, position the skimmer in the water at one end of the pool and walk along opposite sides of the pool with the skimmer in the water between them. At the other end of the pool, the skimmer is removed from the water, debris collected in the net is emptied and the skimmer is folded for storage.

It is an object of the invention to provide an improved pool skimmer which can be used quickly and efficiently.

It is another object of the invention to provide a pool skimmer which is almost as wide as the pool.

It is a further object of the invention to provide a pool skimmer which may be folded when not in use.

DETAILED DESCRIPTION OF THE INVENTION

Figures 1, 2, 3, 4:
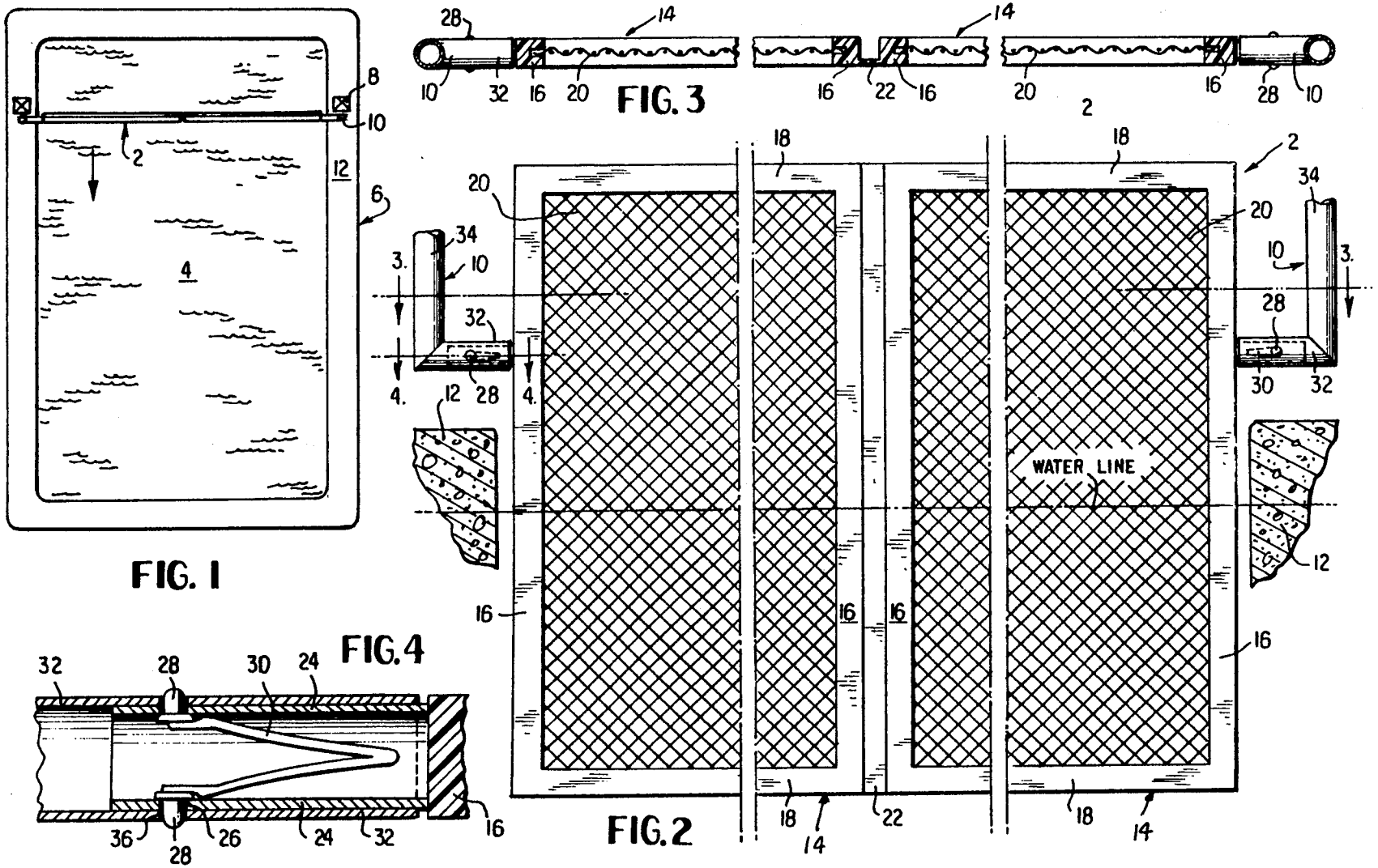
FIG. 1 is a schematic plan view of a skimmer of the invention in a swimming pool, as used.
FIG. 2 is a front elevation view of a skimmer of the invention, reduced in width.
FIG. 3 is a cross-sectional view taken on line 3—3 of FIG. 2.
FIG. 4 is a cross-sectional view taken on line 4—4 of FIG. 2.

A pool skimmer of the invention is made to be substantially the width of the pool to be skimmed and is operated by two persons, one at each end of the device. The skimmer has two elongated rectangular nets, each held in a frame. The frames are hinged together, enabling the skimmer to be folded for easy storage.

In use, handles, such as poles, are attached to each end of the skimmer, and each person takes a pole. The device is then unfolded and put into the water at one end of the pool. Each person walks up a side of the pool with the pole held so that the skimmer is partially submerged with the frame held substantially vertically. At the other end of the pool, the skimmer is lifted from the water and debris is emptied from the net. The skimmer is folded for storage and the poles are removed. A skimmer of the invention is useful for any rectangular pool. The device is preferably made with lightweight plastic or aluminum framing and a lightweight mesh net.

A skimmer of the invention is advantageously quick and easy to use. Keeping a pool free of leaves and other debris becomes a simple matter of moving the skimmer once along the length of the pool and then emptying it and folding it for storage.

With reference to the drawings, in which like numerals represent like parts, FIGS. 1 to 4 show a skimmer 2 and the method of its use.

FIG. 1 illustrates skimmer 2 positioned in the water 4 of a swimming pool 6. Skimmer 2 extends substantially across the width of the pool and may be, in a non-limiting example, about 2 to 6 inches narrower than the pool. Operators 8 hold poles 10 and walk from end to end of pool 6 along pool edges 12.

FIG. 2 shows skimmer 2 in detail but reduced in width. Rectangular skimmer 2 includes two frames 14 each made up of a pair of opposite short frame members 16, a pair of opposite long frame members 18, and a skimming net 20 held in each rectangular frame. The two rectangular frames are positioned side by side, With short sides of the frames adjacent to each other. The adjacent short frame members 16 are hinged together by a hinge 22 which allows the frames to be folded to lie against each other or opened to lie adjacent each other. A typical simple hinge 22 is formed of a flexible plastic web joining adjacent frame members 16. Other appropriate hinges which allow the frames to be folded to lie against each other and unfolded to lie adjacent each other will be known to those skilled in the art.

Handles for carrying the skimmer are attached to hollow tubes 24 joined to an intermediate position on outer short frame members 16. Hollow tubes 24 each have a pair of opposing apertures 26 in the walls thereof for engaging knobs 28 of a wishbone spring clip 30 positioned in each tube 24. The carrying handles are typically poles 10 each having a short portion 32 substantially perpendicular to elongated portion 34. Each short portion 32 fits over a hollow tube 24 and a pair of opposing apertures 36 in each short portion 32 engage over knobs 28 of wishbone spring clip 30. Poles 10 may easily be engaged with hollow tubes 24 by pushing short portions 32 onto tubes 24. Knobs 28 retract and spring back through apertures 36 when poles 10 are in place on tubes 24. To remove poles 10, knobs 28 are squeezed together to allow the poles to be removed for storage.

Skimmer 2 is elongated horizontally to be almost the same width as the pool. The skimmer can be about 2 to 6 inches narrower than the pool, so that the entire pool can be skimmed as the skimmer is moved from one end of the pool to the other. In use, the skimmer is partially submerged in the pool and the approximate level of the water line is shown in FIG. 2. The skimmer may be held substantially upright or tilted at an angle, during skimming. Net 14 may be held coplanar with the frame, as shown in FIG. 3, or the net may be held more loosely, as known to one skilled in the art.

Short tubes 24 for attaching the carrying poles are typically positioned about two-thirds of the distance up the outer short sides of the frames. Poles 10 may be about 6 ft. in length for ease of use, or may be of other length, as known in the art. The poles need not be long straight poles, but may be bent at right angles at a comfortable carrying height, for example at waist height of an average person.

A typical pool skimmer of the invention is about 12 to 24 inches in height and 2 to 6 inches narrower than the pool when unfolded for use. The net is of ⅛ to ½ inch mesh, such as #18 mesh, or as known in the art. The frames and carrying handles may be made of plastic, aluminum or other lightweight material.

While the invention has been described with respect to certain embodiments thereof, it will be appreciated that variations and modifications may be made without departing from the spirit and scope of the invention.

What is claimed is:

1. A pool skimmer comprising:

a pair of rectangular frames, each said frame comprising first and second short frame members and first and second long frame members;

hinge means for folding said pair of frames against each other connecting said pair of frames together along adjacent first short frame members;

a skimming net held by each of said frames;

means for attaching a handle to each of said second short frame members; and a pair of handles having a lower end for engaging with said attaching means and an upper end for being held by an operator substantially above said lower end;

wherein the operators use the device by walking along opposite sides of the pool while moving the device along the pool between them to collect debris from the water, removing the device from the water after use and folding the frames against each other for storage.

2. A pool skimmer according to claim 1 wherein each of said handles comprises an elongated pole.

3. A pool skimmer according to claim 1 wherein said attaching means comprises a hollow tube attached at an intermediate position on the length of each of said second short frame members, wherein one of said handles is engaged with each said hollow tube.

4. A pool skimmer according to claim 3 wherein said attaching means further comprises a wishbone clip engaged with each said hollow tube.

5. A pool skimmer according to claim 4 wherein said wishbone clip comprises a pair of knobs extending through a pair of opposing apertures through each said hollow tube.

6. A pool skimmer according to claim 5 wherein each said handle comprises a pair of opposing apertures for retaining said knobs of said wishbone clip.

7. A pool skimmer according to claim 6 wherein each said handle comprises an elongated pole.

8. A pool skimmer according to claim 1 wherein said hinge means extends substantially the length of the short frame members.

9. A pool skimmer according to claim 8 wherein the hinge means comprises an elongated plastic web connected to each of said adjacent first short frame members.

10. A pool skimmer comprising:

a pair of rectangular frames, each said frame comprising first and second short frame members and first and second long frame members, said pair of frames being hinged together for folding against each other along adjacent first short frame members by a plastic hinge member extending substantially the length of the short frame members;

a skimming net held by each of said frames;

means for attaching a pole to each of said second short frame members comprising a hollow tube attached at an intermediate position on the length of each of said second short frame members, wherein one of said poles is engaged with each said hollow tube; and a pair of elongated poles each having a lower end for engaging with one of said attaching means, and an upper end for being held substantially above said lower end by an operator;

wherein said skimmer extends substantially the width of the pool and is positioned partially submerged in the water at one end of the pool, moved by two operators each holding one of said elongated poles through the water to the other end of the pool and removed from the pool, whereby debris on the pool surface is collected in said net; and wherein said hinged frames of said skimmer are folded together when not in use.

* * * * *